US008928540B2

(12) United States Patent
Desclos et al.

(10) Patent No.: US 8,928,540 B2
(45) Date of Patent: Jan. 6, 2015

(54) MULTI-ANTENNA MODULE CONTAINING ACTIVE ELEMENTS AND CONTROL CIRCUITS FOR WIRELESS SYSTEMS

(71) Applicant: Ethertronics, Inc., San Diego, CA (US)

(72) Inventors: Laurent Desclos, San Diego, CA (US); Sebastian Rowson, San Diego, CA (US); Jeffrey Shamblin, San Marcos, CA (US); Sahil Bansal, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 26 days.

(21) Appl. No.: 13/674,078

(22) Filed: Nov. 11, 2012

(65) Prior Publication Data

US 2013/0141292 A1 Jun. 6, 2013

Related U.S. Application Data

(63) Continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402, said application No. 13/674,078 is a continuation-in-part of application No. 13/289,901, filed on Nov. 4, 2011, which is a continuation of application No. 12/894,052, filed on Sep. 29, 2010, now Pat. No. 8,077,116, which is a continuation of application No. 11/841,207, filed on Aug. 20, 2007, now Pat. No. 7,830,320.

(51) Int. Cl.
*H01Q 25/04* (2006.01)

(52) U.S. Cl.
USPC ..... 343/745; 343/702; 343/815; 343/833; 343/876

(58) Field of Classification Search
CPC ..... H01Q 1/243; H01Q 21/28; H01Q 25/04; H01Q 3/00; H01Q 9/0421
USPC ..... 343/700 MS, 702, 745, 750, 813, 815, 343/833, 834, 876
See application file for complete search history.

(56) References Cited

U.S. PATENT DOCUMENTS

| | | | | |
|---|---|---|---|---|
| 5,235,343 | A * | 8/1993 | Audren et al. | 343/816 |
| 5,420,599 | A * | 5/1995 | Erkocevic | 343/828 |
| 6,040,803 | A * | 3/2000 | Spall | 343/700 MS |
| 6,765,536 | B2 * | 7/2004 | Phillips et al. | 343/702 |
| 7,180,464 | B2 * | 2/2007 | Chiang et al. | 343/833 |
| 8,378,898 | B2 * | 2/2013 | Man et al. | 343/702 |

* cited by examiner

*Primary Examiner* — Tho G Phan
(74) *Attorney, Agent, or Firm* — Coastal Patent Law Group, P.C.

(57) ABSTRACT

An antenna system is provided for use in wireless communication, the antenna system is contained in a modular structure. The antenna system includes a plurality of co-located antennas, including at least one active modal antenna, each of the antennas being adapted for operation at a distinct frequency band. The antenna system further includes an active tuning module for tuning a frequency response of the co-located antennas.

20 Claims, 4 Drawing Sheets

MULTI-ANTENNA MODULE CONTAINING ACTIVE ELEMENTS AND CONTROL CIRCUITS FOR WIRELESS SYSTEMS

CROSS-REFERENCE TO RELATED APPLICATIONS

This application is a CIP of U.S. Ser. No. 13/029,564, filed Feb. 17, 2011, and titled "ANTENNA AND METHOD FOR STEERING ANTENNA BEAM DIRECTION", which is a CON of U.S. Ser. No. 12/043,090, filed Mar. 5, 2008, titled "ANTENNA AND METHOD FOR STEERING ANTENNA BEAM DIRECTION", now issued as U.S. Pat. No. 7,911,402; and a CIP of U.S. Ser. No. 13/289,901, filed Nov. 4, 2011, titled "ANTENNA WITH ACTIVE ELEMENTS", which is a CON of U.S. Ser. No. 12/894,052, filed Nov. 29, 2010, titled "ANTENNA WITH ACTIVE ELEMENTS", now U.S. Pat. No. 8,077,116, which is a CON of Ser. No. 11/841,207, filed Aug. 20, 2007, titled "ANTENNA WITH ACTIVE ELEMENTS", now U.S. Pat. No. 7,830,320;

the contents of each of which are hereby incorporated by reference.

BACKGROUND OF THE INVENTION

1. Field of the Invention

This invention relates to antennas for use in wireless communication systems, and more particularly to an antenna module containing multiple co-located antennas with a plurality of active control elements for dynamically tuning the antenna module over multiple bands.

2. Description of the Related Art

As new generations of handsets and other wireless communication devices become smaller and embedded with increased applications, new antenna designs are required to address inherent limitations of these devices and to enable new capabilities. With classical antenna structures, a certain physical volume is required to produce a resonant antenna structure at a particular frequency and with a particular bandwidth. In multi-band applications, more than one such resonant antenna structure may be required. But effective implementation of such complex antenna arrays may be prohibitive due to size constraints associated with mobile devices.

Current wireless devices contain multiple antennas that are used to service a wide variety of functions including cellular, GPS, Bluetooth, WLAN, FM, WiMax, and others. Typically these antennas are distributed around the wireless device and the performance of the total antenna system is optimized per device. Substantial resources are expended in an effort to prepare the multi-antenna system to operate in an optimized state, with this time consuming process needing to be repeated from one product to the next. The small size of current wireless devices substantially effects antenna performance due to the dependence of the antenna on the size of the ground structure that the antenna is coupled to. The circuit board of the wireless device provides the ground plane function for the antenna. The circuit board dimensions are chosen to accommodate the wireless circuit and cannot be optimized for antenna performance. A ground plane that is one quarter wave length in extent is optimal for antenna performance, which results in antenna performance varying greatly over wide frequency bandwidths.

A solution is hereby proposed which yields an antenna system module configured to contain one or more co-located active and passive antennas, and a number of active control elements within a common assembly. The antenna system module will provide simplified installation and tuning of the antennas as well as a small form factor for containing multiple antennas and is dedicated to supporting a variety of multimedia applications, including one or more of: cellular communications, GPS, FM, Bluetooth, WLAN, and WiMax, among others.

SUMMARY OF THE INVENTION

A modular antenna system, or antenna module, comprises a plurality of co-located passive and active antenna structures, an antenna tuning module (ATM), and a control system provides a highly optimized solution to improve wireless system communication performance. Communication link quality as well as ease of integration is provided by an active multi-antenna modular approach to servicing antenna functions in a wireless device.

BRIEF DESCRIPTION OF THE DRAWINGS

The invention can be further understood upon review of the following detailed description in conjunction with the appended drawings, wherein.

DETAILED DESCRIPTION OF THE PREFERRED EMBODIMENTS

Figure 1A:
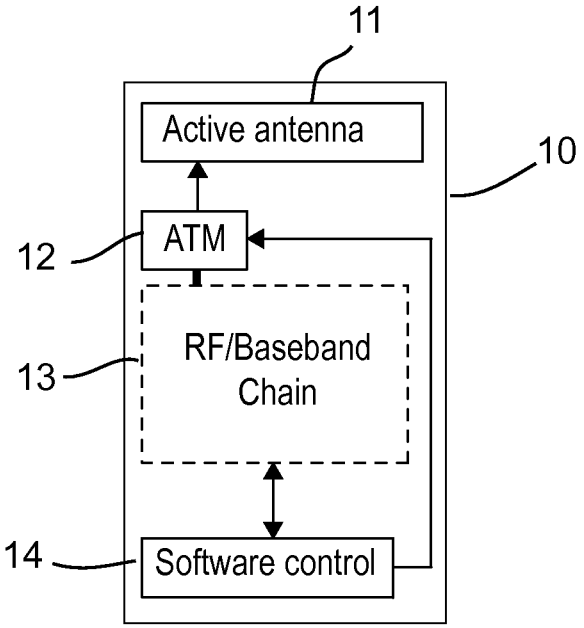
FIG. 1*a* illustrates a schematic of an antenna system module in accordance with an embodiment, wherein an active antenna is coupled to an antenna tuning module (ATM), which is further coupled to an RF/Baseband Chain. Software residing in the ATM, or alternatively within the baseband processor, determines an optimal antenna mode and the antenna tuning module configures the active antenna for producing the optimal mode.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Commonly owned, U.S. Pat. No. 7,911,402, titled "ANTENNA AND METHOD FOR STEERING ANTENNA BEAM DIRECTION", and U.S. Pat. No. 7,830,320, titled "ANTENNA WITH ACTIVE ELEMENTS", disclose antenna systems capable of beam steering, band switching, active matching, and other active tunable characteristics; the contents of each of which are hereby incorporated by reference. These antennas utilize a radiating element and one or more parasitic elements coupled to active elements in a manner for enabling switching, variable reactance, and other tuning of the antenna components. The resulting structure is an active tunable antenna capable of operating in multiple modes, otherwise termed an "active modal antenna" or "modal antenna". The referenced patents disclose active modal antennas and thus details of these structures will not be discussed in detail herein.

In various embodiments herein, an antenna system module is provided containing a collection of co-located antennas, selected from passive and active antennas, along with active elements and a control system to dynamically tune the antennas.

In one embodiment, the active elements are assembled into an antenna tuning module (ATM). The tuning functions incorporated into the multiple antennas provide for a reconfigurable antenna module that can be optimized for a wide variety of devices and form factors.

In another embodiment, the active elements are positioned outside of the antenna tuning module and are coupled to a microprocessor for receiving control signals for configuring the various modes of an active modal antenna.

In one embodiment, a microprocessor is integrated into the antenna tuning module to allow for full control of the tuning functions required of the multi-antenna system. Alternately, the microprocessor can operate in conjunction with the processors in baseband and other portions of the wireless device. For example, the microprocessor can operate in conjunction with a control system such as a radiofrequency (RF) front end module and a baseband processor, or "RF/Baseband Chain", such that the various antennas within the antenna system module are configured for mode selection and/or impedance matching via the control system.

The "antenna system module" or "multi-antenna module" as used herein refers to a modular structure containing one or more antennas, and preferably a first active modal antenna and one or more additional antennas that may be active or passive antennas, and an antenna tuning module comprising a microprocessor adapted to receive input signals and generate output signals for configuring the one or more antennas within the modular structure.

A housing or base may be used to affix or place the antennas in position within the modular structure. The housing or base may be fabricated of plastic or a dielectric material.

An "antenna tuning module" as used herein describes, in accordance with an embodiment, a circuit module within the antenna system, comprising: a microprocessor, one or more active elements, a dual directional coupler, and a matching component. The components within the antenna tuning module may vary across a number of embodiments. For example, a matching circuit can be provided within the antenna tuning module for matching a passive antenna; however the matching circuit is not always required. In general form, the antenna tuning module comprises a microprocessor and one or more active elements adapted to adjust corresponding modes of an attached active modal antenna.

An "active modal antenna" as referred to herein includes an antenna capable of selective operation about a plurality of modes, wherein each of said plurality of modes generates a distinct antenna radiation pattern resulting from the first active modal antenna. In this regard, the active modal antenna can be reconfigured as necessary to provide an optimal radiation pattern. This is accomplished by one or more of: band-switching, beam steering, and active impedance matching as environmental effects detune the antenna. In representative examples, an active modal antenna comprises a radiating structure disposed above a circuit board and forming an antenna volume therebetween; a parasitic element positioned adjacent to the radiating structure; and an active element coupled to the parasitic element; wherein the active element is configured for one or more of: adjusting a reactance of the parasitic element, or shorting the parasitic element to ground.

As referenced herein, an "active element" may comprise at least one of: a voltage controlled tunable capacitor, voltage controlled tunable phase shifter, field-effect transistor (FET), tunable inductor, switch, or any combination thereof.

The tuning functions designed into the antenna tuning module provide an antenna system that adapts to environmental changes such as head and hand effects. Beam steering is incorporated into one or multiple antennas in the multi-antenna module to provide multiple radiation pattern modes for link quality improvement. Alternately, the beam steering function can be used to modify antenna parameters to improve isolation between pairs of antennas or to reduce Specific Absorption Rate (SAR) and/or Hearing Aid Compatibility (HAC).

The multi-antenna module is capable of both open and closed loop operation. For example, band switching, where the frequency response of the antenna is changed to allow the antenna to operate in another band, can be implemented open loop, with no correction for environmental affects. An example of closed loop operation is when the active matching circuit in the ATM is adjusted based upon metrics related to environmental effects such as reflected power monitored in the ATM and commands sent to the active element in the matching circuit to correct for impedance mismatch of the antenna.

Thus, in accordance with one preferred embodiment, an antenna system comprises: a first active modal antenna capable of selective operation about a plurality of modes, wherein each of the plurality of modes generates a distinct antenna radiation pattern resulting from the first active modal antenna; one or more passive antenna structures; and an antenna tuning module coupled to the first active modal antenna, the antenna tuning module comprising a microprocessor adapted to receive one or more input signals and produce one or more output signals for selecting a mode of the first active modal antenna.

The first active modal antenna may comprise: a radiating structure disposed above a circuit board and forming an antenna volume therebetween; a parasitic element positioned adjacent to the radiating structure; and an active element coupled to the parasitic element; wherein the active element is configured for one or more of: adjusting a reactance of the parasitic element, or shorting the parasitic element to ground.

The parasitic element may be disposed outside of the antenna volume and adjacent to the radiating structure.

The antenna system may comprise two or more parasitic elements. The antenna system may further comprise a first parasitic element positioned within the antenna volume and coupled to a first active element, and a second parasitic element positioned outside of the antenna volume and coupled to a second active element.

One or more of the active elements of the first active modal antenna can be disposed within the antenna tuning module.

Alternatively, one or more of the active elements can be positioned outside of the antenna tuning module.

The first active modal antenna, the passive antenna structures, and the antenna tuning module may be commonly housed within a modular structure.

The input signals may comprise one or more of: antenna select, power ramp, and power detect signals.

The antenna system may comprise two or more active modal antennas. In this regard, the antenna tuning module is adapted to configure the respective modes of each of the two or more active modal antennas. One or multiple processors can be provided within the antenna tuning module depending on device requirements.

The microprocessor within the antenna tuning module can be configured to operate with a baseband processor within a wireless device for controlling active elements of the first active modal antenna, and additional antennas if desired.

The antenna tuning module can comprise at least one antenna matching circuit.

The antenna tuning module can be adapted to select a mode of the first active modal antenna based on one or more metrics selected from: specific absorption rate, and hearing aid compatibility. In this regard, the mode can be determined by software located in a baseband processor of a wireless device. Alternatively, the mode can be determined by software located in the antenna tuning module.

The passive antennas may be adapted to operate within one or more bands selected from: GPS, WLAN, WiMax, Bluetooth, and FM bands.

In another preferred embodiment, an antenna system comprises: a modular structure; a first active modal antenna capable of selective operation about a plurality of modes, wherein each of said plurality of modes generates a distinct antenna radiation pattern resulting from the first active modal antenna; a second antenna; and an antenna tuning module. The antenna tuning module may further comprise: a microprocessor adapted to receive one or more input signals and generate one or more output signals for communicating to one or more active elements associated with the first active modal antenna; and a dual directional coupler coupled with a matching component for impedance matching the first active modal antenna; wherein said first active modal antenna, said second antenna, and said antenna tuning module are each disposed about said modular structure.

In some embodiments, the antenna tuning module is adapted to impedance match the second antenna.

In another preferred embodiment, an antenna system comprises: a first active modal antenna capable of selective operation about a plurality of modes, wherein each of the plurality of modes generates a distinct antenna radiation pattern resulting from the first active modal antenna; a second passive antenna structure; and an antenna tuning module; wherein the antenna tuning module is adapted to configure the mode of the first active modal antenna; and wherein the antenna tuning module is adapted to impedance match the second passive antenna structure.

Now turning to the figures, FIG. 1*a* illustrates a schematic of an antenna system module 10 in accordance with the above embodiments, the antenna system module 10 contains an active modal antenna 11 along with an antenna tuning module (ATM) 12. Software 14 to drive the active modal antenna may reside in the baseband processor as shown, or within the antenna tuning module (not shown).

Figure 1B:
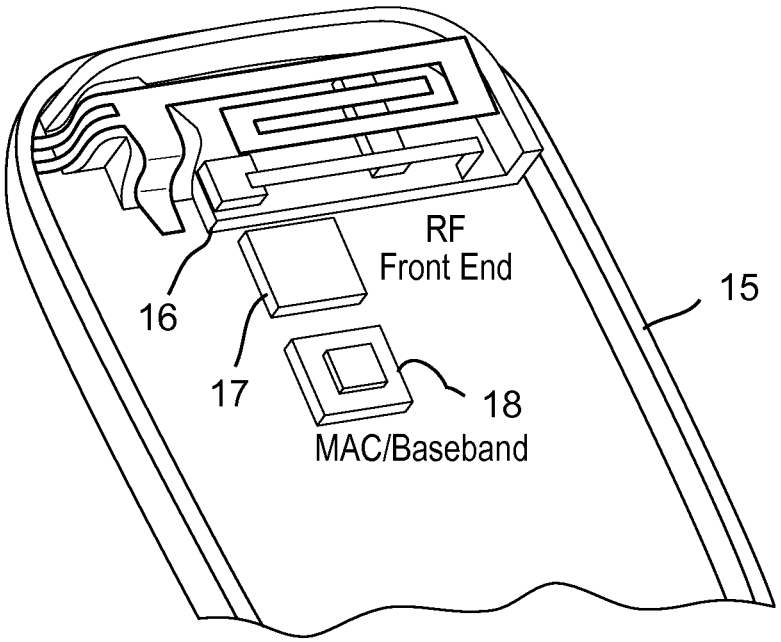
FIG. 1*b* illustrates a wireless device containing an antenna system module in accordance with the embodiments, a radiofrequency (RF) front end module and a baseband processor, or "RF/Baseband Chain".

FIG. 1*b* further illustrates the embodiment of FIG. 1*a*, wherein a portion of a wireless device 15 contains an antenna system module in accordance with the above embodiments. The antenna system module is adapted to be connected to one or both of an RF front end module 17 and a MAC/Baseband processor 18, collectively referred to as the "RF/Baseband Chain" 13 in FIG. 1*a*. The antenna system module comprises a first active modal antenna and an antenna tuning module (ATM) compactly formed with one or more additional antenna structures within a modular structure or housing 16.

The one or more additional antenna structures may comprise one or more parasitic elements for configuring various modes of an active modal antenna, or one or more additional antennas such as passive antennas for supporting various media applications.

Figure 2A:
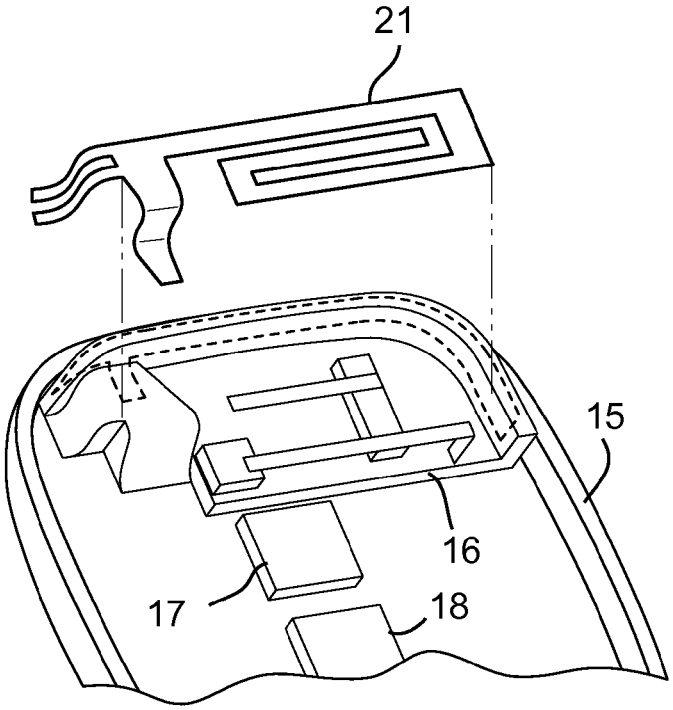
FIG. 2*a* illustrates the antenna system module of FIGS. 1(*a*-*b*) in expanded form within a portion of the wireless device.
Figure 2B:
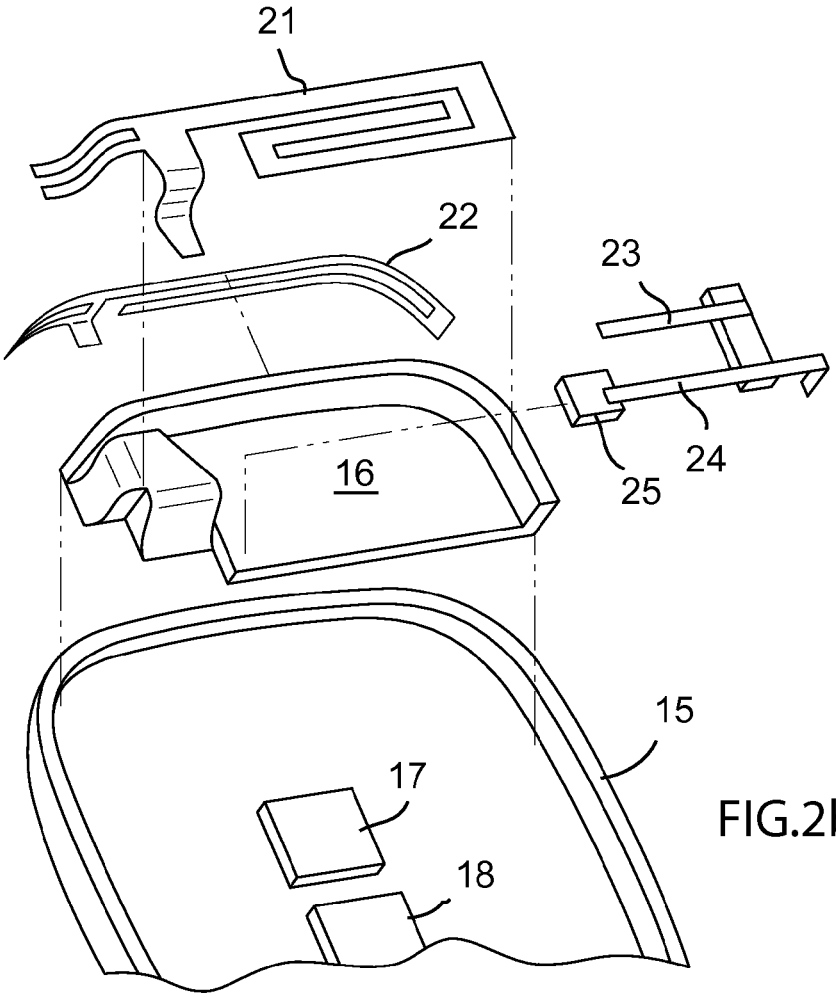
FIG. 2*b* further illustrates the expanded view of the antenna system module of FIG. 2*a*; multiple antennas are co-located within the antenna system module.

FIGS. 2(*a*-*b*) illustrate an expanded view of the active modal antenna, second antenna 22, and antenna tuning module 25 each disposed within the multi-antenna system. The second antenna 22 may comprise a GPS, Bluetooth, FM, or a media antenna for TV reception. A plurality of antennas can be combined into the module, however only two antennas are shown in FIG. 2 for simplicity. The active modal antenna comprises a radiating structure 21 adapted to be disposed above a circuit board or module base 16 of a modular structure to form an antenna volume therebetween. A first parasitic element 23 is adapted for positioning within the antenna volume; when a reactance of the first parasitic element 23 is adjusted the resulting antenna radiation pattern is shifted in frequency response, resulting in a band-switching antenna function. A second parasitic element 24 is positioned adjacent to the radiating structure and outside of the antenna volume; when a reactance of the second parasitic element 24 is adjusted the resulting antenna radiation pattern is rotated, resulting in a beam-steering antenna function. Each of the first and second parasitic elements 23; 24, respectively, is coupled to an active element of the antenna tuning module 25.

Figure 3:
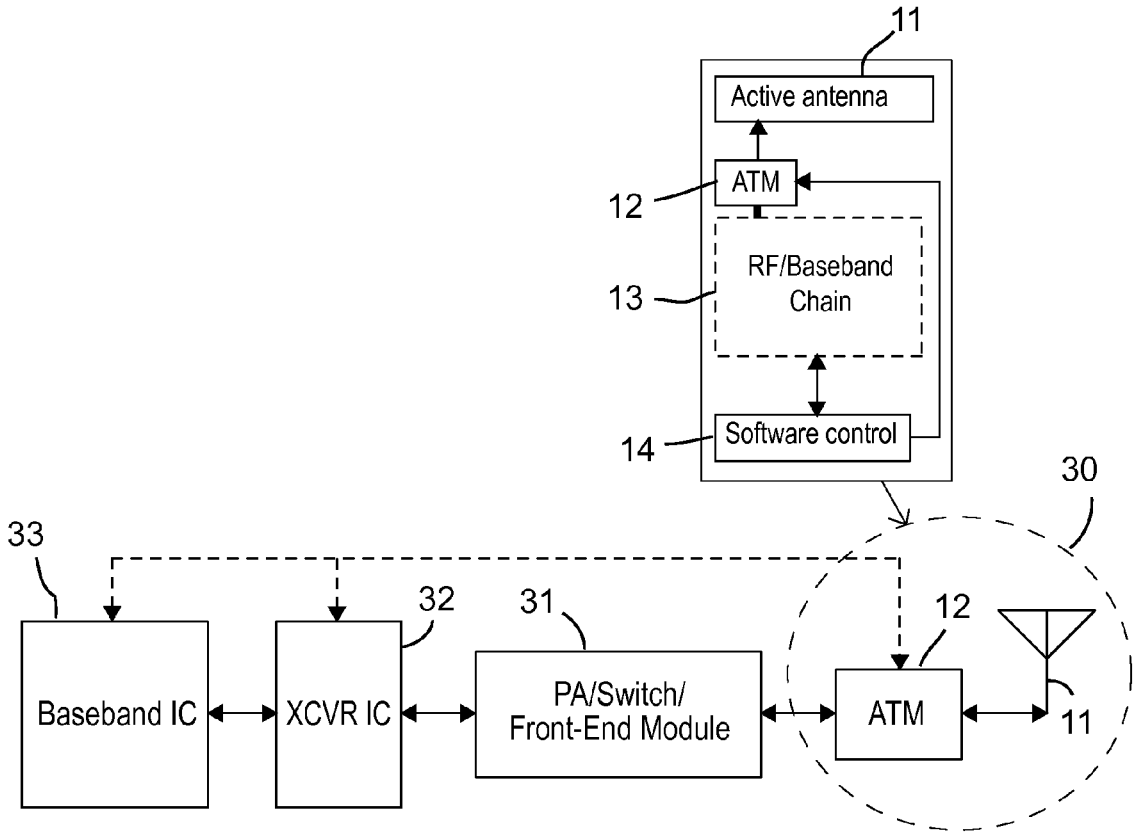
FIG. 3 illustrates an embodiment wherein software configured to drive the multi-antenna module resides in the baseband chain of the wireless device.

FIG. 3 illustrates an embodiment wherein software 14 configured to drive the multi-antenna module resides in the baseband chain 13 of the wireless device.

Figure 4:
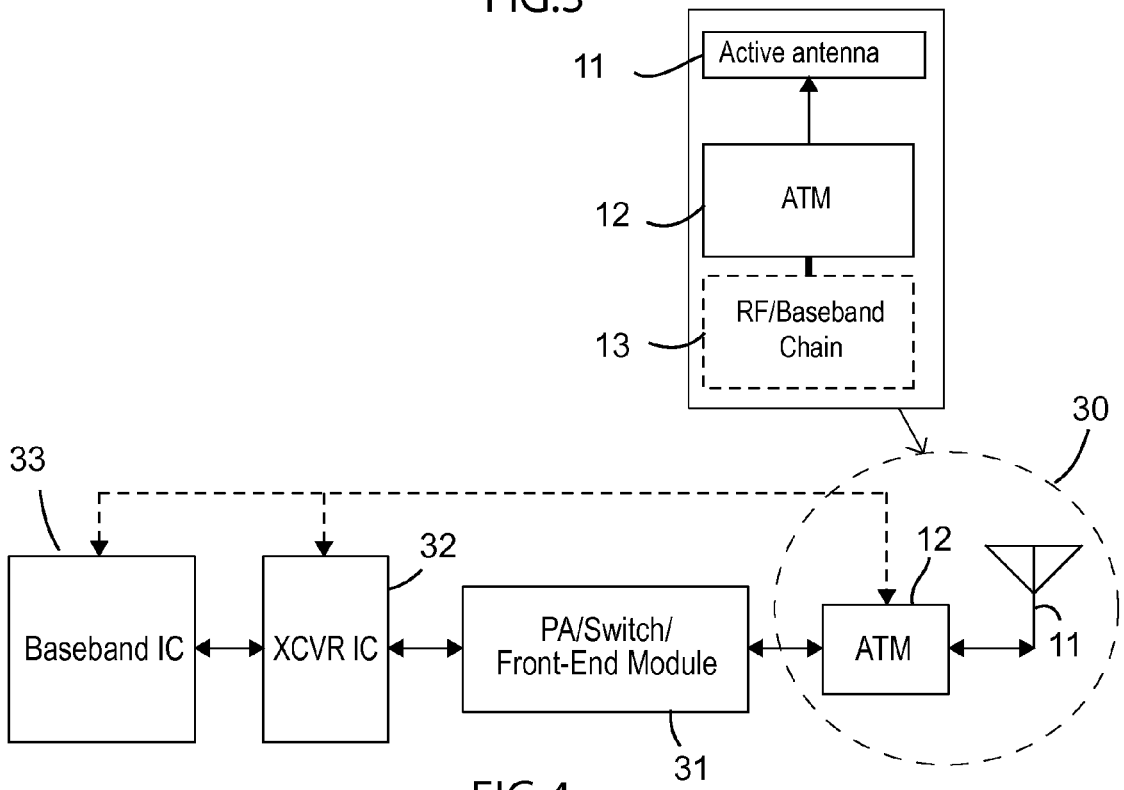
FIG. 4 illustrates an embodiment wherein software configured to drive the multi-antenna modules resides in a microprocessor within the antenna tuning module.

FIG. 4 illustrates an embodiment wherein software configured to drive the multi-antenna modules resides in a microprocessor within the antenna tuning module 12.

The antenna system module is represented by a dashed-circle 30 in each of FIGS. 3-4. A schematic representation shows the respective embodiments, wherein software control is implemented in either of the RF/Baseband Chain 13, or within the antenna tuning module 12, respectively. The front end of the antenna system generally comprises a Baseband integrated circuit 33, a transceiver integrated circuit 32, and a power amplifier/switch/front-end module 31. In each of these embodiments, the baseband and transceiver are adapted to communicate control signals and RF to the antenna tuning module (ATM).

Figure 5:
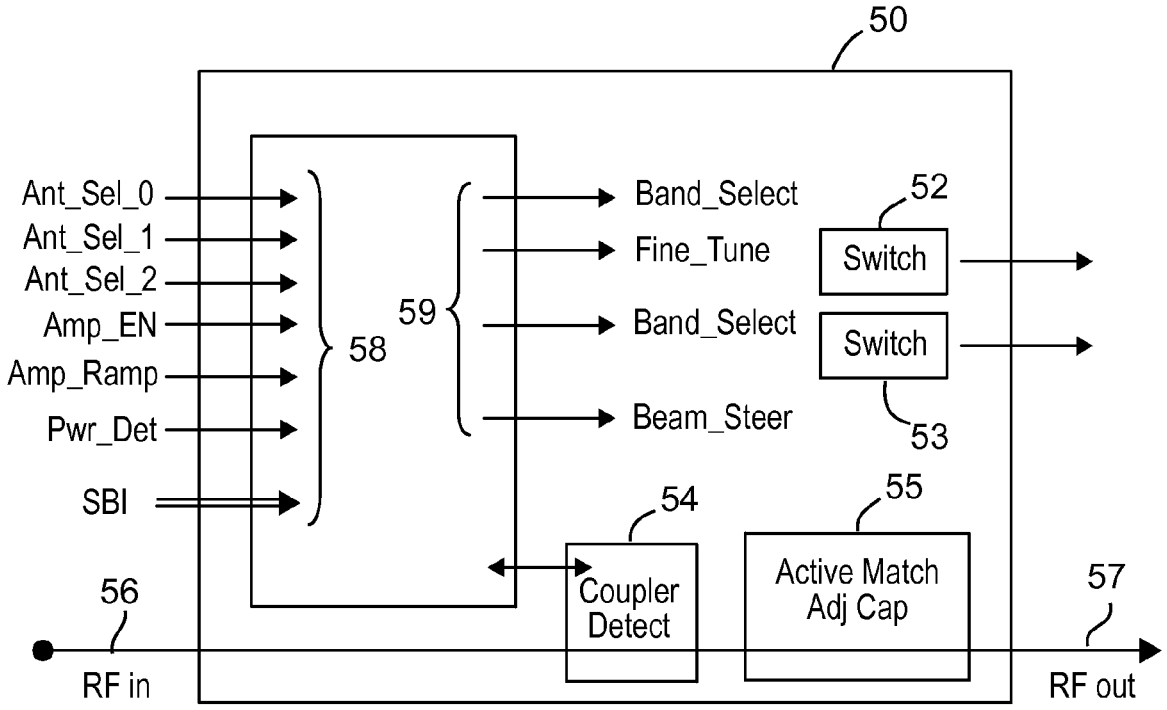
FIG. 5 illustrates an antenna tuning module in accordance with embodiments herein, the antenna tuning module comprises a microprocessor adapted to receive multiple input signals such as antenna select, power ramp, and power detect, and further adapted to produce output signals for configuring one or more active modal antennas coupled to the antenna tuning module.

FIG. 5 illustrates an example of an antenna tuning module (ATM) 50 for use in the above embodiments. Multiple inputs 58, such as antenna select, power ramp, and power detect, are fed into a microprocessor 51. Outputs 59 of the microprocessor 51 are command signals for controlling antenna functions, such as band switching, impedance matching, and beam steering. These output signals 59 control switches 52; 53 and other active elements to tune and modify antenna performance. Radiofrequency (RF) input and output ports 56; 57, respectively, are included in the ATM 50. A dual directional coupler 54 detects reflected power and an active matching circuit 55, or tunable component, is adjusted for matching the antenna coupled therewith.

Figure 6:
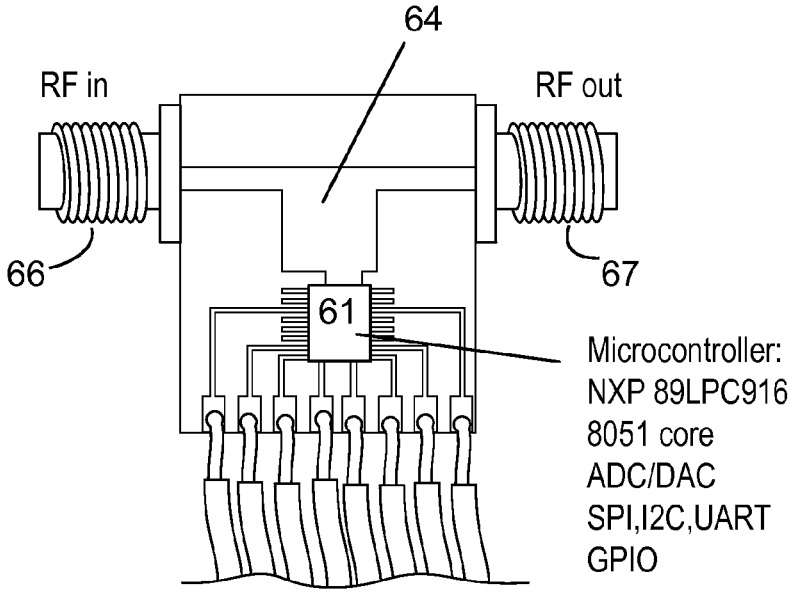
FIG. 6 illustrates a prototype that was produced by the inventors and tested for functionality; a NXP 89LPC916 microcontroller was used as described in the figure.

FIG. 6 is a sketch of a prototype ATM 60 that was developed by the inventors. The ATM 60 provides some of the basic functions required for antenna control. Reflected power is detected by a dual directional coupler 64 and an active element coupled to the antenna for band switching is adjusted to optimize impedance match. The microcontroller 61 selected for use in the prototype is labeled in the sketch. The resulting ATM produced the desired results when coupled with an active modal antenna.

What is claimed is:

1. An antenna system, comprising:

a first active modal antenna capable of selective operation about a plurality of modes, wherein each of said plurality of modes generates a distinct antenna radiation pattern resulting from the first active modal antenna;

one or more passive antenna structures; and an antenna tuning module coupled to the first active modal antenna, the antenna tuning module comprising a microprocessor adapted to receive one or more input signals and produce one or more output signals for selecting a mode of the first active modal antenna.

2. The antenna system of claim 1, said first active modal antenna comprising:

a radiating structure disposed above a circuit board and forming an antenna volume therebetween;

a parasitic element positioned adjacent to the radiating structure; and an active element coupled to the parasitic element;

wherein said active element is configured for one or more of: adjusting a reactance of the parasitic element, or shorting the parasitic element to ground.

3. The antenna system of claim 2, wherein said parasitic element is disposed outside of said antenna volume and adjacent to the radiating structure.

4. The antenna system of claim 2, comprising two or more parasitic elements.

5. The antenna system of claim 4, comprising a first parasitic element positioned within the antenna volume and coupled to a first active element, and a second parasitic element positioned outside of the antenna volume and coupled to a second active element.

6. The antenna system of claim 5, wherein said active elements individually comprise: a voltage controlled tunable capacitor, a tunable inductor, a switch, or a combination thereof.

7. The antenna system of claim 2, wherein said active elements are disposed within the antenna tuning module.

8. The antenna system of claim 1, wherein the first active modal antenna, the passive antenna structures, and the antenna tuning module are each housed within a modular structure.

9. The antenna system of claim 1, wherein said input signals comprise one or more of: antenna select, power ramp, and power detect signals.

10. The antenna system of claim 1, comprising two or more active modal antennas.

11. The antenna system of claim 10, wherein the antenna tuning module is adapted to configure the respective modes of each of the two or more active modal antennas.

12. The antenna system of claim 1, wherein the microprocessor within the antenna tuning module is configured to operate with a baseband processor within a wireless device for controlling active elements of the first active modal antenna.

13. The antenna system of claim 1, wherein said antenna tuning module comprises at least one antenna matching circuit.

14. The antenna system of claim 1, wherein said antenna tuning module is adapted to select a mode of the first active modal antenna based on one or more metrics selected from: specific absorption rate, and hearing aid compatibility.

15. The antenna system of claim 14, wherein said mode is determined by software located in a baseband processor of a wireless device.

16. The antenna system of claim 14, wherein said mode is determined by software located in the antenna tuning module.

17. The antenna system of claim 1, wherein said passive antennas are adapted to operate within one or more bands selected from: GPS, WLAN, WiMax, Bluetooth, and FM bands.

18. An antenna system, comprising a modular structure;

a first active modal antenna capable of selective operation about a plurality of modes, wherein each of said plurality of modes generates a distinct antenna radiation pattern resulting from the first active modal antenna;

a second antenna; and an antenna tuning module;

said antenna tuning module comprising:

a microprocessor adapted to receive one or more input signals and generate one or more output signals for communicating to one or more active elements associated with the first active modal antenna; and a dual directional coupler coupled with a matching component for impedance matching the first active modal antenna;

wherein said first active modal antenna, said second antenna, and said antenna tuning module are each disposed about said modular structure.

19. The antenna system of claim 18, wherein said antenna tuning module is adapted to impedance match the second antenna.

20. An antenna system, comprising:

a first active modal antenna capable of selective operation about a plurality of modes, wherein each of said plurality of modes generates a distinct antenna radiation pattern resulting from the first active modal antenna;

a second passive antenna structure; and an antenna tuning module;

wherein the antenna tuning module is adapted to configure the mode of the first active modal antenna; and wherein the antenna tuning module is adapted to impedance match the second passive antenna structure.

* * * * *